US005233732A

United States Patent [19]

Yamanishi

[11] Patent Number: 5,233,732

[45] Date of Patent: Aug. 10, 1993

[54] SEAT BELT BUCKLE

[75] Inventor: Takahiro Yamanishi, Shiga, Japan

[73] Assignee: Takata Corporation, Tokyo, Japan

[21] Appl. No.: 912,187

[22] Filed: Jul. 13, 1992

[30] Foreign Application Priority Data

Jul. 19, 1991 [JP] Japan ..... 3-179372

[51] Int. Cl.[5] ..... A44B 11/00; B60R 22/00

[52] U.S. Cl. ..... 24/303; 24/633; 280/804

[58] Field of Search ..... 24/303, 49 M, 94, 688, 24/616, 163 K, 603, 633; 292/251.5; 63/29.2, 14.1; 335/285; 280/804, 803; 242/107.7, 107.6, 107.4 B

[56] References Cited

U.S. PATENT DOCUMENTS 3,027,617 4/1962 Gray ..... 24/303
3,376,616 4/1968 Kaczorowski ..... 24/303
3,589,341 6/1971 Krebs ..... 24/303
4,036,322 7/1977 Takada et al. ..... 242/107.4 B
4,387,862 6/1983 Sakurada et al. ..... 242/107.6
4,943,087 7/1990 Sasaki ..... 280/804
5,060,977 10/1991 Saito ..... 280/804

FOREIGN PATENT DOCUMENTS 0605196 5/1960 Italy ..... 24/303

*Primary Examiner*—Victor N. Sakran
*Attorney, Agent, or Firm*—Kanesaka and Takeuchi

[57] ABSTRACT

A seat belt buckle for securing a tongue of a seat belt comprises an insertion passage for inserting the tongue, a latch device for preventing the tongue from being pulled out from the insertion passage, and a magnetic biasing device for biasing magnetically the tongue in the direction of insertion.

6 Claims, 4 Drawing Sheets

SEAT BELT BUCKLE

BACKGROUND OF THE INVENTION

The present invention relates to a buckle for a seat belt provided in a vehicle in order to protect an occupant, and in particular to a seat belt buckle provided with a mechanism for pulling a tongue into the interior of the buckle.

A seat belt is constructed so as restrain by means of a belt an occupant sitting in a seat in a vehicle by inserting a tongue into a buckle provided at the side of the seat and latching it with a latch device.

In known seat belts, the occupant has to grasp the tongue with a hand and push it deep into the buckle. However, in order to perform this operation, the occupant sitting in the seat twists the upper half of his body to the side, which causes the problem that the upper half of the body is in an uncomfortable posture, and this hampers the operation of fastening the buckle.

SUMMARY OF THE INVENTION

An object of the present invention is to provide a seat belt buckle for which the operation for engaging tongue and buckle can be performed with extreme ease, because, when the front end of the tongue is inserted into the inlet of the buckle, the tongue projection is attracted into the receptacle of the buckle by magnetic force and latched by a latch device.

A further object of the present invention is to provide a seat belt buckle whose tongue can be strongly biased by an electromagnet.

Another object of the present invention is to provide a seat belt buckle which exerts a powerful pulling-in force on the, tongue at the beginning of pulling-in, because the tongue is pulled in by an electromagnet disposed at the entrance portion of the insertion passage.

A yet further object of the present invention is to provide a seat belt buckle which can reliably to pull the tongue very deep into the buckle, because the tongue is pulled in more strongly as it advances into the interior of the buckle, since an electromagnet is provided at the innermost end in the buckle.

Yet another object of the present invention is to offer a seat belt buckle which can with extreme ease accept and secure the tongue, because when the tongue is inserted into the inlet of the buckle, the tongue is then automatically pulled in.

According to a first form of the invention, there is provided a seat belt buckle for securing a tongue of a seat belt, comprising: an insertion passage for inserting the tongue; a latch device for preventing the tongue from being pulled out from the insertion passage; and a magnetic biasing device for biasing the tongue in the direction of insertion by magnetic force in the insertion passage.

According to a second form of the invention, there is provided a seat belt buckle of the form 1, in which the magnetic biasing device is an electromagnet.

According to a third form of the invention, there is provided a seat belt buckle of the form 2, in which the electromagnet comprises a tubular core having therein the insertion passage, and a coil wound on the core, whereby the electromagnet may be energized so as to pull the tongue into the interior of the core.

According to a fourth form of the invention, there is provided a seat belt buckle of the form 2, in which the electromagnet is disposed at the innermost extremity of the insertion passage, and the electromagnet attracts the tongue into the buckle when the electromagnet is energized.

According to a fifth form of the invention, there is provided a seat belt buckle of any of forms 2 through 4, in which, tongue detecting sensors are provided at the insertion passage inlet portion and the insertion passage deep interior, the inlet portion sensor upon detecting the tongue causes an electromagnet to be energized, and the deep interior sensor upon detecting the tongue causes the electromagnet to be demagnetized.

In the seat, belt, buckle, of the first form, when the front end of the tongue is slightly inserted inside the tongue receiving inlet, the tongue is magnetically biased and thus pulled into the buckle and latched by a latch device. As a result an occupant can achieve full insertion of the tongue into the buckle without pushing it by himself deep inside the buckle.

In the second form, the tongue is biased by an electromagnet.

In the third form, the tongue is biased so that it is attracted into the interior of a tubular core.

In the fourth form, the tongue is biased so that it is attracted by the electromagnet which is located deeply inside the buckle.

In the fifth form, when the tongue is engaged with the inlet of the buckle the electromagnet is energized and the tongue is biased in the direction of insertion. When the tongue has moved deep into the buckle, the electromagnet is demagnetized. Thus, because current is supplied to the electromagnet only when it biases the tongue, little electric power is consumed.

DESCRIPTION OF THE PREFERRED EMBODIMENTS

Figure 1:
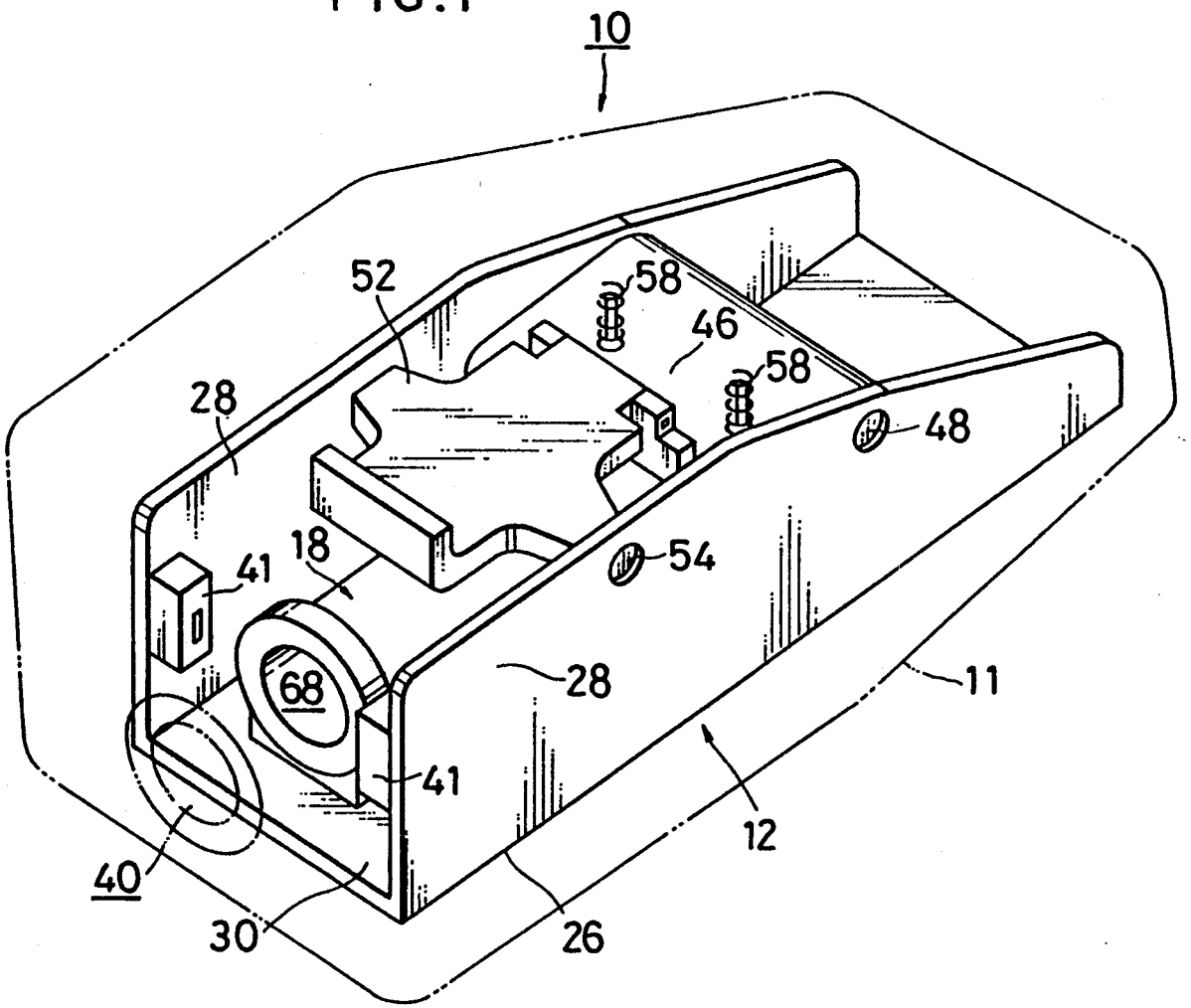
FIG. 1 is a transparent perspective view of a buckle according to an embodiment of the invention.

Embodiments of the invention will be explained using the figures.

A seat belt buckle 10 shown in FIGS. 1 to 4 is formed of a mechanism 12 retained inside a synthetic resin cover 11. This mechanism 12 has a tubular first electromagnet 18 into which the cylindrical tongue projection 16 of a tongue 14 is inserted, and a second electromagnet 20 which draws the tongue projection 16. The seat belt buckle 10 is provided with a latching device 24 which engages with and latches a latch groove 22 of the tongue projection 16 when the tongue 16 is inserted.

A base 26 of the buckle mechanism 12 has a pair of side-plates 28 and a main plate 30 joining them. The first electromagnet 18 is arranged on the front portion of the base 26 and the second electromagnet 20 on the rear portion of the base 26. The first electromagnet 18 has a tubular core **18*a* and a coil 18*b* wound on this core 18*a***.

Similarly, the second electromagnet 20 has a tubular core 20a and a coil 20b wound on the core 20a. The second electromagnet 20 is attached to the base 26 by an anchoring block 32. A backplate 34 is attached rigidly to the rear surface of the core 20a.

An ejector 36 and an ejector spring 38 are provided in the core 20a. The ejector 36 slides freely inside the core 20a. The spring 38 pushes forward the ejector 36.

An inlet 40 is provided at the front end of the cover 11. The inlet 40 permits the tongue projection 16 of the tongue 14 to be inserted therethrough. A first sensor 41 is provided, on the base 26 to face the inlet 40, for detecting the tongue 14. A second sensor 42 is provided deep inside the case 11 in proximity to the second electromagnet 20.

The latch device 24 has a latch member 46 having at a front end thereof a latch catch 44 which engages with latching groove 22 of the tongue projection 16, and a pin 48 which pivotally supports the rear end of the latch member 46 on the base 26. The device 24 further comprises a lever 52 which is attached pivotally by a pin 50 to the front of the latch member 46; a pin 54 which pivotally supports the longitudinally central portion of lever 52 on base 26; a pushbutton 56 which is mounted on the lever 52; and a spring 58 which biases latch member 46.

Figure 7:
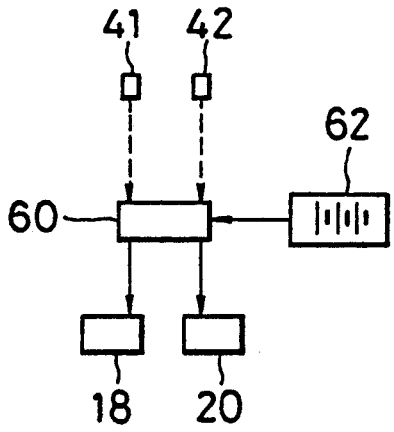
FIG. 7 is a diagram of a control system of a buckle.

As shown in FIG. 7 the detection signals from sensors 41 and 42 are inputted into a controller 60 which controls the supply of electric power from a vehicle's battery 62 to electromagnets 18 and 20.

Figure 6:
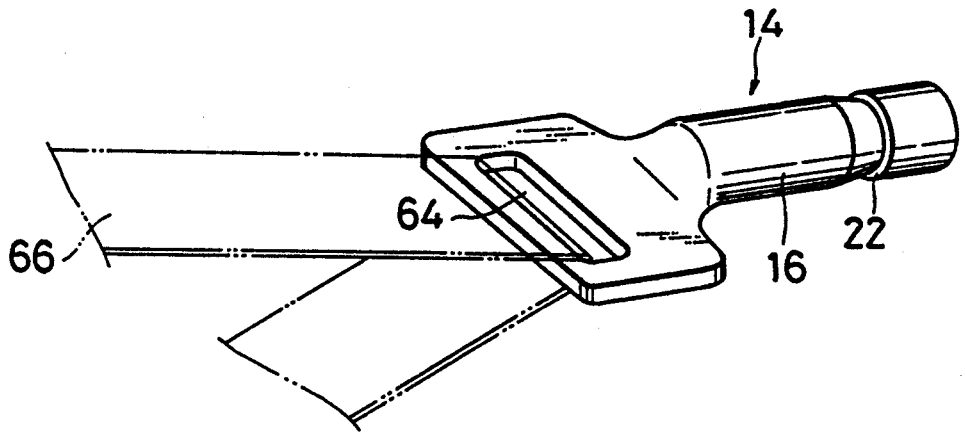
FIG. 6 is a perspective view of a tongue.

In FIG. 6, 64 denotes a slot for belt 66. In this embodiment, at least the tongue projection 16 of the tongue 14 is made of steel, and thus can be attracted by the electromagnet.

As is clear from the above explanation, in this embodiment the space from the interior of core 18a of the electromagnet 18 to the front end of electromagnet 20 forms a tongue insertion passage 68.

In the seat belt buckle 10 constructed as described, when the tongue projection 16 of the tongue 14 is inserted into the inlet 40, the tongue 14 is detected by the first sensor 41. As a result, current is supplied to the electromagnets 18 and 20, and they are magnetized. As a result, the tongue projection 16 which has been inserted into the inlet 40 is attracted by the magnetic force to the first electromagnet 18 and thus moves into the interior of the buckle 10. When the front end of the tongue projection 16 has passed through the core 18a of the electromagnet 18, the electromagnet 18 scarcely attracts the tongue projection 16, but the second electromagnet 20 attracts the tongue projection 16 and the tongue projection 16 is brought even deeper into the interior of buckle 10, and at least the front surface of the tongue projection 16 contacts the front surface of the electromagnet 20. At this moment, the tongue projection 16 has reached the deepest end of the passage, and then the latch groove 22 of the projection 16 engages with the latch pawl 44 of the latch member 46 of the latch device 24, so that the tongue 14 is prevented from being removed.

When the tongue projection 16 advances so far as to contact the electromagnet 20, the second sensor 42 detects the tongue 14, and accordingly the electric power to electromagnets 18 and 20 is stopped.

A described above, when the front end of the tongue projection 16 of the tongue 14 is inserted into the inlet 40, the tongue projection 16 is thereafter automatically attracted by magnetic force, and is latched when it has been introduced deepest in the buckle 10.

Figure 2:
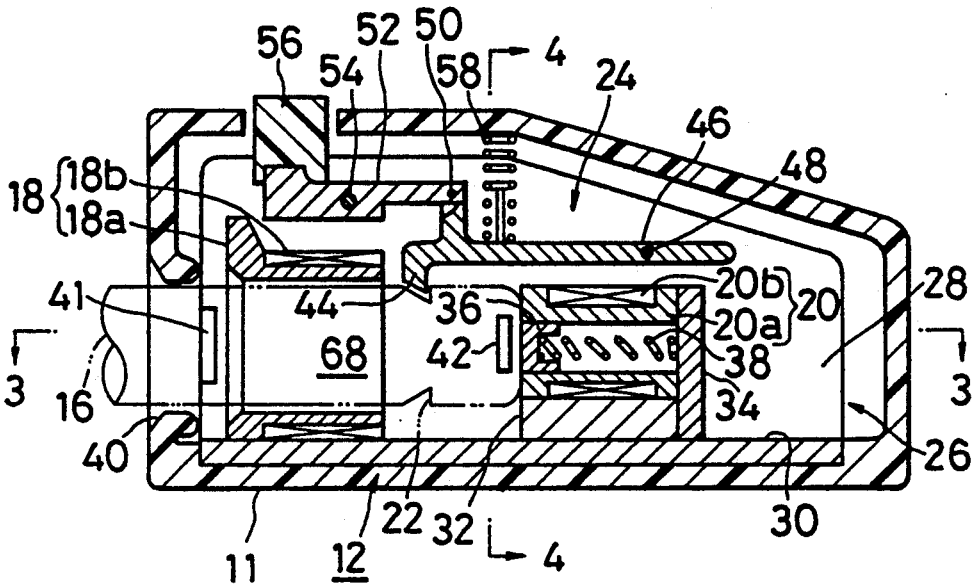
FIG. 2 is a vertical sectional view of the embodiment shown in FIG. 1.
Figure 3:
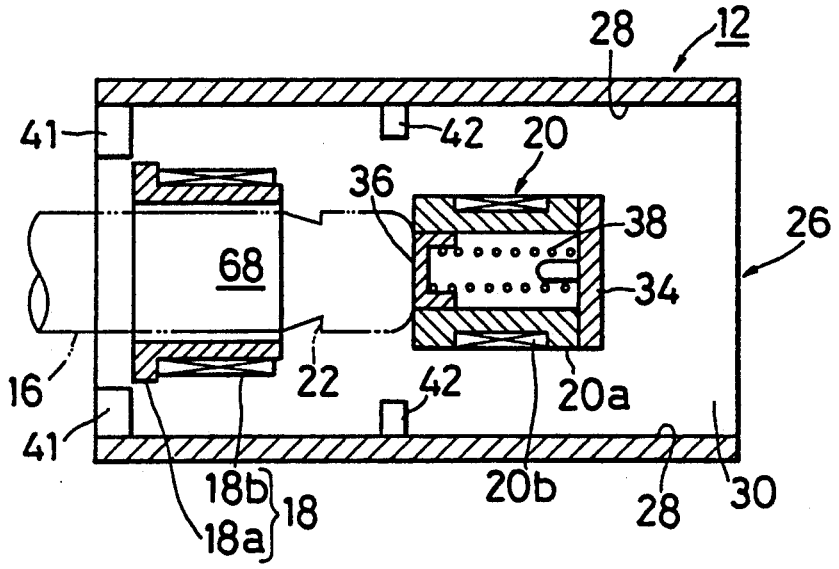
FIG. 3 is a sectional view of the interior mechanism taken along the line 3—3 in FIG. 2.
Figure 4:
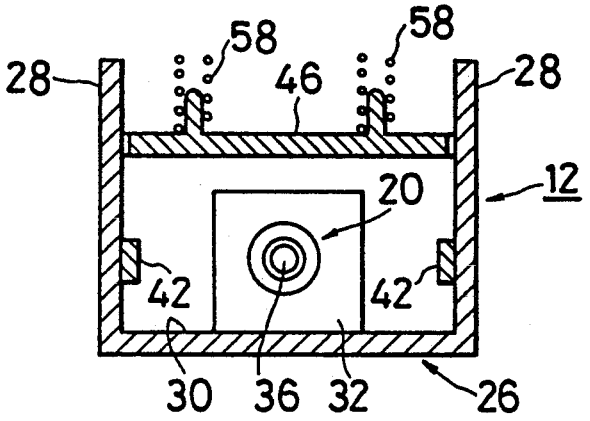
FIG. 4 is a sectional view of interior mechanism taken along the line 4—4 in FIG. 2.

The pushbutton 56 is pushed to unlatch the tongue 14, whereby the latch pawl 44 of the latch member 46 is pulled upwards in FIG. 2. Then the ejector 36 biased by the ejector spring 38 pushes the tongue 14, and the tongue projection 16 is moved toward the outside of buckle 10.

In the above embodiment, the tongue 14 is pulled into the buckle 10 by two electromagnets 18 and 20, but it is also acceptable that the tongue is pulled into the buckle by only either one of the two electromagnets.

Figure 5:
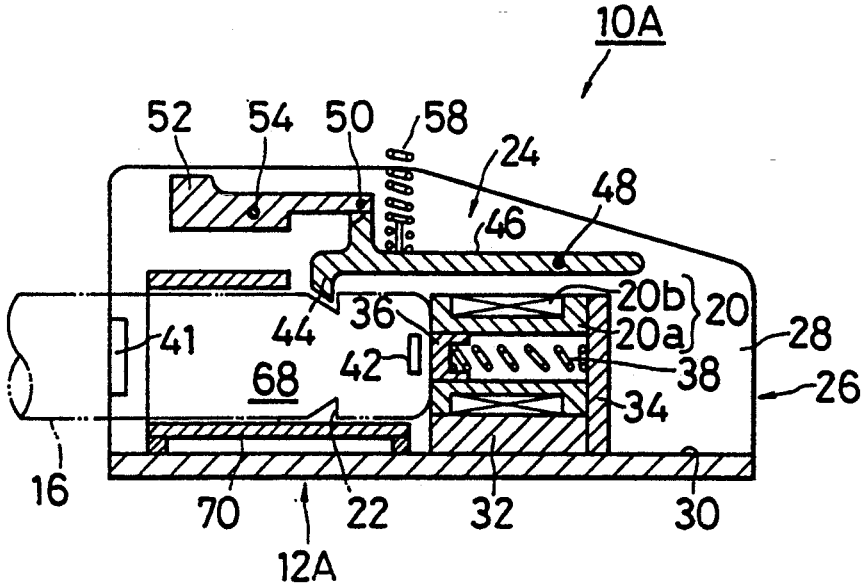
FIG. 5 is a vertical sectional view of the interior mechanism of a buckle according to another embodiment.

FIG. 5 is a vertical sectional view showing an interior mechanism 12A of a buckle 10A relating to an embodiment in which the first electromagnet 18 of the previously described embodiment is eliminated and the tongue is pulled in by only the second electromagnet 20.

In this embodiment, in place of the first electromagnet 18 a cylinder 70 made of a magnetic material is fixed on the base 26. When the tongue projection 16 is pushed into the inlet 40 of the buckle 10A, the electromagnet 20 is energized and magnetic flux of the electromagnet 20 flows into a cylinder 70, and magnetic force acts to attract the tongue projection 16 in the tongue insertion direction. As a result, the tongue projection 16 is pulled into the buckle 10A. The electromagnet 20 attracts the buckle 10A more strongly as the tongue projection 16 is moved deeper into the interior of the buckle 10A. Thus the tongue projection 16 is pulled deep inside buckle 10A until the front end of the projection 16 makes contact with the electromagnet 20 and the projection 16 is latched by the latch device 24.

Other members of buckle 10A in FIG. 5 and action thereof are same as in FIG. 2, and the same numeral denotes the same member as in FIG. 2 so that the same description will not be repeated.

What is claimed is:

1. A seat buckle for securing a tongue of a seat belt, comprising:

an insertion passage for inserting said tongue and having an inlet portion;

a latch device for preventing said tongue from being pulled out from said insertion passage when the tongue is fully inserted in the insertion passage; and an electromagnet for magnetically biasing said tongue in a direction of insertion, said electromagnet, when the tongue is positioned at the inlet portion, being energized to thereby pull the tongue completely into the insertion passage to allow the tongue to engage the latch device automatically.

2. A seat belt buckle according to claim 1, in which said electromagnet is provided respectively at an inlet portion and an innermost portion of the insertion passage.

3. A seat belt buckle according to claim 1, in which said electromagnet is disposed at an innermost portion of said insertion passage, so that the electromagnet attracts the tongue into the buckle when it is energized.

4. A seat belt buckle according to claim 1, in which tongue detecting sensors are provided at both of an inlet portion and the innermost portion of said insertion passage whereby said electromagnet is energized when said sensor at said inlet portion detects the tongue, and said electromagnet is disenergized when said sensor at said innermost portion detects the tongue.

5. A seat buckle for securing a tongue of a seat belt, comprising:

an insertion passage for inserting said tongue and having an inlet portion and an innermost portion;

a latch device for preventing said tongue from being pulled out from said insertion passage; and electromagnets for biasing magnetically said tongue in a direction of insertion, each electromagnet including a tubular core having an interior of the insertion passage and a coil wound on the core and being provided at the inlet portion and the innermost portion so that the electromagnets are energized to pull the tongue into the interior of the core.

6. A seat belt buckle for securing a tongue of a seat belt, comprising:

an insertion passage for inserting said tongue and having an inlet portion and an innermost portion;

a latch device for preventing said tongue from being pulled out from said insertion passage;

an electromagnet for biasing magnetically said tongue in a direction of insertion and disposed at the innermost portion so that the electromagnet attracts and the tongue into the buckle when energized; and a tubular core made of a magnetic material and formed at the inlet portion so that when the electromagnet is energized, magnetic flux from the electromagnet at the innermost portion flows also into the core and the tongue pushed into the inlet portion is drawn into the insertion passage.

* * * * *